United States Patent [19]

Fatool et al.

[11] Patent Number: 4,542,901

[45] Date of Patent: Sep. 24, 1985

[54] SAFETY BASE

[75] Inventors: Francis N. Fatool; James L. Gordon, both of Sunbury, Pa.

[73] Assignee: J. D. & C., Inc., Sunbury, Pa.

[21] Appl. No.: 446,956

[22] Filed: Dec. 6, 1982

[51] Int. Cl.[4] ..... A63B 71/00

[52] U.S. Cl. ..... 273/25

[58] Field of Search ..... 273/25, 55 R, DIG. 9; 272/76, 77, 78; 5/419, 490, 434; 6/201, 202, 203

[56] References Cited

U.S. PATENT DOCUMENTS

| | | | |
|---|---|---|---|
| D. 260,206 | 8/1981 | Molnar | D6/201 |
| 1,244,044 | 10/1917 | Falconer | 273/25 |
| 2,084,775 | 6/1937 | Orefice | 273/25 |
| 2,121,742 | 6/1938 | McLaughlin | 273/25 |
| 2,122,266 | 6/1938 | Seys | 273/25 |
| 2,275,547 | 2/1940 | Mouch | 273/25 |
| 2,405,492 | 10/1944 | Corbett | 273/25 |
| 2,624,580 | 6/1951 | Corbett | 273/25 |
| 2,695,784 | 8/1952 | Orsatti et al. | 273/25 |
| 3,126,203 | 3/1964 | Bourret | 273/25 |
| 3,466,039 | 9/1969 | Golomb | 273/25 |
| 3,508,747 | 4/1970 | Orsatti | 273/25 |
| 3,971,558 | 7/1976 | Gardetto | 273/25 |
| 4,162,789 | 7/1979 | Holloway | 273/25 |
| 4,218,059 | 8/1980 | Eiden | 273/25 |
| 4,253,661 | 3/1981 | Russell | 272/DIG. 9 |
| 4,266,768 | 5/1981 | Hall | 273/25 |
| 4,398,714 | 8/1983 | Fuller et al. | 273/25 |

FOREIGN PATENT DOCUMENTS

| | | | |
|---|---|---|---|
| 776483 | 6/1957 | United Kingdom | 5/434 |

*Primary Examiner*—Richard C. Pinkham
*Assistant Examiner*—T. Brown
*Attorney, Agent, or Firm*—Thomas Hooker

[57] ABSTRACT

A safety base comprising a cushion and root formed of a resilient material with a protective wrapping and a ground support having an aperture for receiving the root and holding the base in a desired orientation on the playing field. The force of a player sliding into the base deforms the base and pops it free of the ground support without injury to the player.

14 Claims, 11 Drawing Figures

SAFETY BASE

The invention relates to a baseball safety base for reducing injuries to players sliding into the base. The base includes a cushion which rests upon the playing field and integral root which extends from the bottom of the cushion down into a buried ground support. The ground support locates and orients the base on the field. The base and root are formed from a resilient material and are provided with a protective wrapping. A player sliding into the base with sufficient energy to risk injury deforms the base and root so that the base pops free of the ground support without injury to the player.

Conventional baseball bases are immovably secured to buried ground supports. Players sliding into these immovable bases are subjected to high loading forces which may result in injury including broken legs, sprains, torn ligaments and the like. Young and amateur baseball players are particularly susceptible to base sliding injuries.

Conventional connections of the bases to the field are taught by U.S. Pat. Nos. 2,405,492, 2,624,580, 2,695,784 and 3,466,039. These patents also teach that it is old to secure a base to the playing field by a rigid member permanently attached to the underside of the base having a sliding fit into a buried ground support.

U.S. Pat. Nos. 1,244,044 and 2,275,547 disclose bases securely attached to the ground with limited give to reduce injury to players. In the former patent, the base is attached to the rigid ground support by a spring connection which allows limited movement of the base. In the latter patent, the base includes a rubber cushion immovably anchored to the playing field.

U.S. Pat. No. 4,266,768 discloses a safety base where the base rests flush on the upper surface of the buried ground support and is secured to the ground support by a number of relatively large area breakaway connections. These connections may be of Velcro-type. A player sliding into the base breaks the connections thereby freeing the base from the support. In practice, the effectiveness of the breakaway connections used in this base is reduced by dirt, stones and the like from the playing field.

In addition to patents disclosing bases for use in play in the game of baseball, the prior art includes U.S. Pat. Nos. 2,662,768 and 4,218,059 disclosing burying resilient rubber members on the baseball field so that one surface of the member is essentially flush with the surface of the field. In the first patent, a pitcher's rubber surrounds a cylindrical concrete plug which holds the rubber in place. In the second patent, a buried ground support extends along the foul lines and holds a permanently attached rubber cushioning member which serves to mark the foul lines. This member is color coded to function as a visable line.

The present invention comprises a safety base having a cushion with an integral root extending from the bottom of the cushion into a buried ground support. The root locates the base on the playing field in proper orientation. The cushion and root define a core of resilient deformable material which compress and absorb energy when a player slides into the base. A strong protective wrapping is bonded to the body to protect them from wear and puncture by cleats and to aid in securing the root to the cushion. The length and loose fit of the root within the ground support permit the base to pop free of the ground support when deformed by a player sliding into the base. This happens before the build up of forces sufficiently high to injure the player. The base is easily repositioned for play be simply inserting the root into the ground support.

The cushion and root body is preferably formed of a strong resilient material such as a foamed polyvinal cloride with the root bonded to the bottom of the cushion by a suitable glue forming a chemical joint between the two. The protective wrapping surrounding the cushion and root is made of strong, tightly woven synthetic cloth bonded to the body material by a vinyl paint to form a strong wear resistant base. Extra layers of cloth are bonded to the bottom of the cushion and sides of the root in order to assure that loadings exerted on the root by players sliding into the cushion deforms the root to permit disengagement of the root from the ground support without shearing the root from the cushion.

Other objects and features of the invention will become apparent as the description proceeds, especially when taken in conjunction with the accompanying drawings illustrating the invention, in which there are three sheets and one embodiment.

IN THE DRAWINGS

Figure 1:
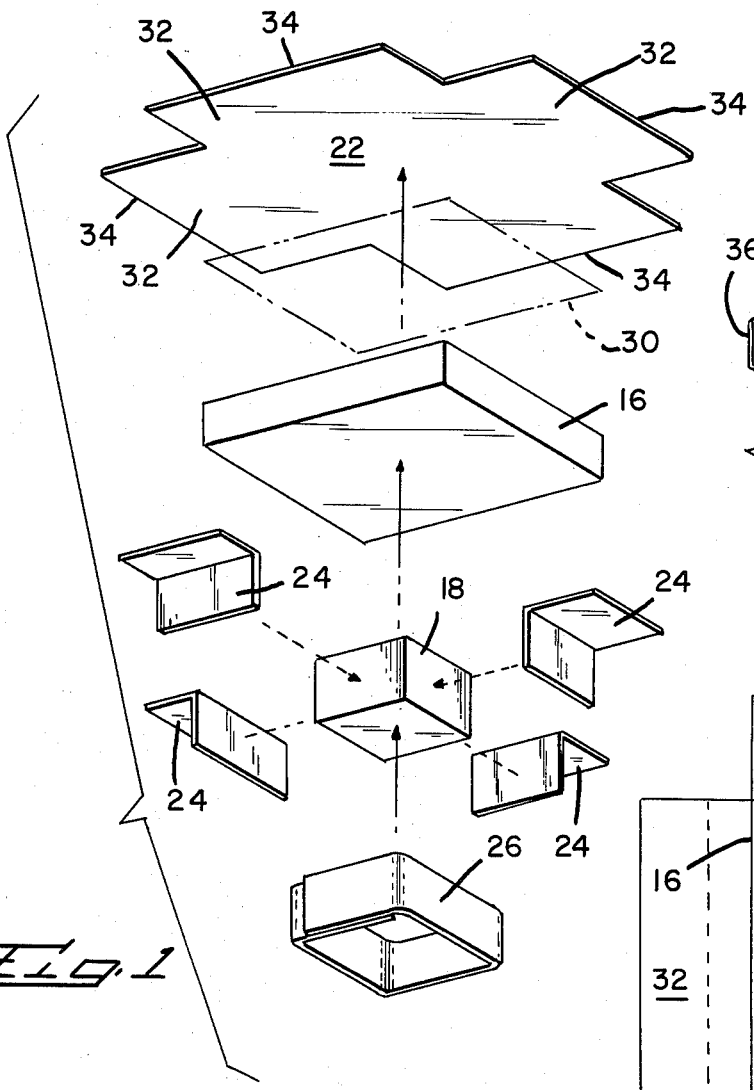
FIG. 1 is an exploded view of a safety base according to the invention.
Figure 2:
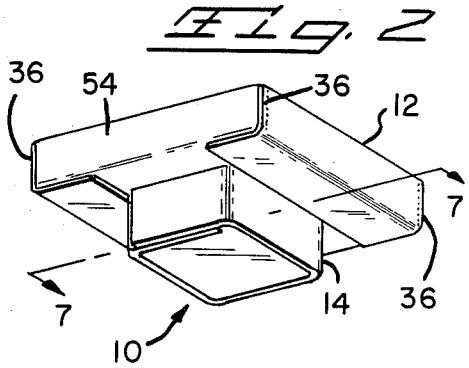
FIG. 2 is a perspective view of the base.
Figure 3:
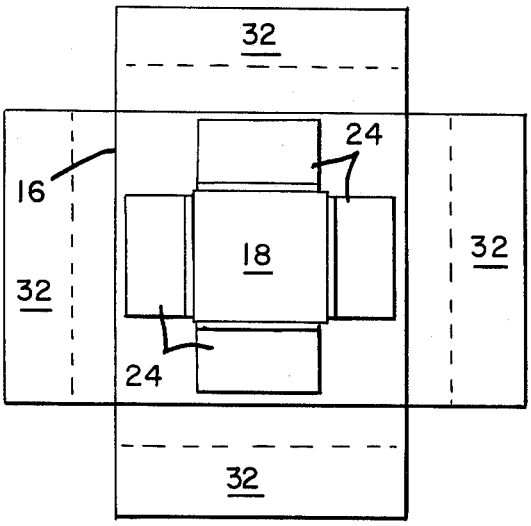
FIGS. 3 through 6 are bottom views of the base illustrating its manufacture.
Figure 7:
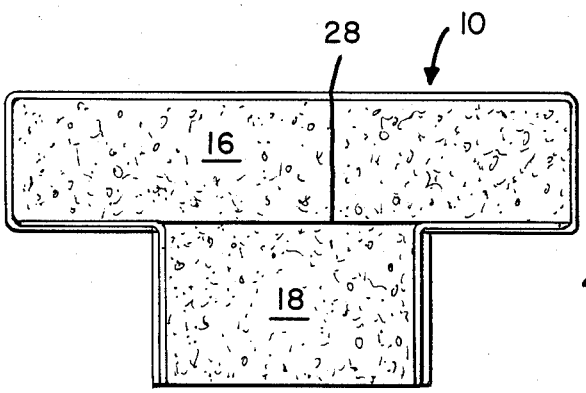
FIG. 7 is a sectional view taken along line 7—7 of FIG. 2.

The safety base 10 of FIGS. 2 and 7 includes a flat square cushion 12 and a square root 14 secured to the bottom of the cushion. The cushion and root are both formed from body elements 16 and 18 made of resilient material. A strong protective cloth wrapping 20 surrounds the body elements. The wrapping includes a number of cloth pieces 22 through 26, as illustrated in FIG. 1.

Both body elements are preferably formed from material capable of elastic deformation under stress to absorb loading and then return to its original shape. We have found the cushion and root body elements may be formed from a foamed polyvinyl cloride having a density of 4 to 6 pounds per cubic foot and a 25 percent compression resistance to a 4 to 6 pounds per square inch loading. In a rebound test, a one and one fourth ounce steel ball dropped from 30 inches has a 17 percent maximum rebound at 75° Farenheit. This body material is marketed in sheets by Housatonic Ever-Float Company, Inc. of Shelton, Conn. under the designation M425. The body elements 16 and 18 are preferably cut from body material of this type, although other resilient body materials capable of absorbing body shock may be used, if desired.

The root and cushion body elements are glued together at joint 28 with the root core extending from the center of the bottom of the cushion body. Its sides parallel the sides of the cushion body. The glue chemically joins the body elements to form an integral body to prevent shearing of the cushion from the root during play.

The cloth pieces 20 through 26 are preferrably formed from a durable high friction and tightly woven synthetic fiber capable of being strongly bonded to itself and to the body material. Tightly woven 8 ounce polyester fabric as marketed by Celanese Corporation under the trademark Fortrel may be used. This fabric is soft like cotton but has a very dry finish, may easily be sewn and is exceedingly durable.

As shown in FIG. 1, the square cushion 12 is formed from a sheet of body material having a thickness suitable for the desired base. For a Little League base, the thickness of the cushion may be 2¼ inches while a cushion for adult use may have a thickness of 3½ inches. The Little League cushion is 14 inches square while the adult base cushion may be 15 inches square. The root 14 for each base is 7 inches square with a length of about 3½ inches.

The wrapping 20 surrounding the joined cushion and root includes a main cushion cloth 22 that surrounds cushion core 16, four joint reinforcement cloths 24 which are secured to the body elements to either side of the joint 28 and reinforce the joint and a root wrapping cloth 26 which extends around the sides of the root and the portions of the reinforcement cloths overlying the root. In the case of bases intended for adult use, a reinforcing top cloth 30 having the same size as the top of the cushion 16 may be sandwiched between the top of the cushion and the wrapping.

Figure 9:
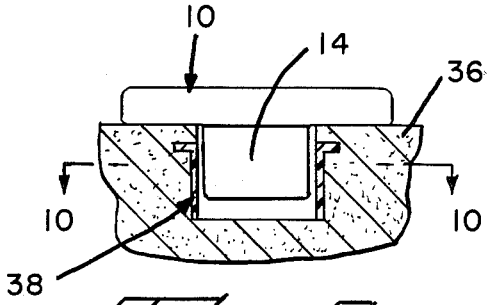
FIG. 9 illustrates a base positioned on a playing field with the root in the ground support.

The base 10 is assembled from the components shown in FIG. 1 by gluing one end of root 14 to the center of the bottom of the cushion as described. This assures that the base is properly oriented on the field when the root is seated in the ground support as shown in FIG. 9. Next, the four right angle reinforcement cloths 24 are bonded to the sides of the root and cushion body elements across the joint 28 by vinyl paint. The paint forms a tight chemical bond between the cloth and the body elements.

Figure 4:
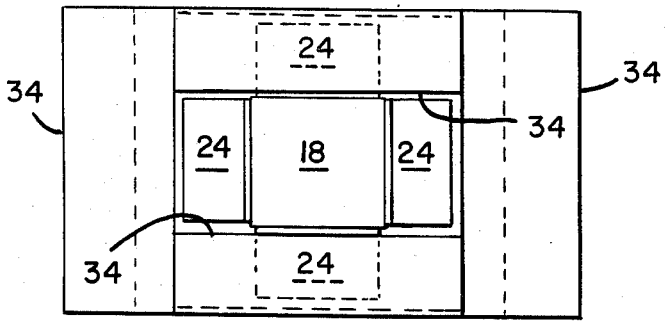
Figure 5:
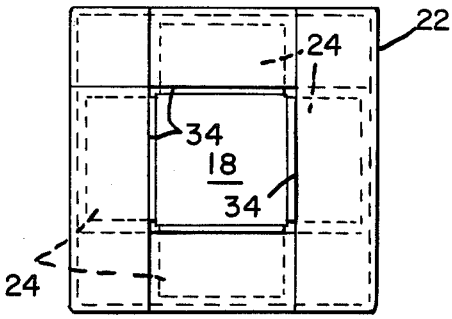
Figure 6:
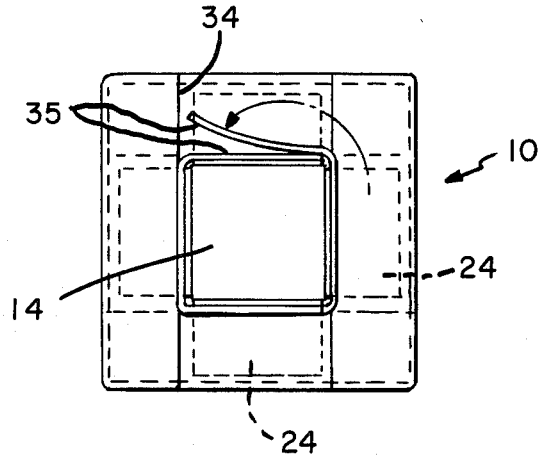

With the root secured on the cushion and the cloths 24 in place, the reinforcement top cloth 30, if used, is bonded to the top of the cushion by vinyl paint and the cushion cloth 22 is bonded to the top of the cushion and cloth 30, if used, by vinyl paint. Cloth 22 may have sewn corners to fit snugly around the side corners of the cushion, if desired. In either case, the cloth 22 is bonded to the top of the cushion and the wrapping edges or flaps 32 are folded around the sides of the cushion and bonded against sides and bottom of the cushion, overlaping the portions of the reinforcement cloths 24 secured to the bottom of the cushion. The folding of the main wrapping 22 about the cushion is illustrated in FIGS. 4 and 5. Opposite flaps 32 are folded and bonded to the cushion and then the remaining flaps are folded over them and bonded in place. When completed, the outer flap edges 34 fit in the Vees of the reinforcement cloths 24 and the wrapping 22 surrounds the cushion as shown in FIG. 2. The main wrapping of the base of FIG. 2 includes sewn corners 36 for improved strength.

The base 10 is completed by bonding root wrapping 26 to the sides of the root 18 with wrapping ends 35 overlying each other on one side, thereby further strengthing the root and the connection between the cushion and root. The cloths 22–26 are bonded to themselves and to the body by suitable layers of vinyl paint. The exterior of the completed base may be coated with a number of layers of vinyl paint in order to further strengthen the base. The resultant base 10 has a strong integral body which is virtually indestructible during playing of the game of baseball.

Figure 8:
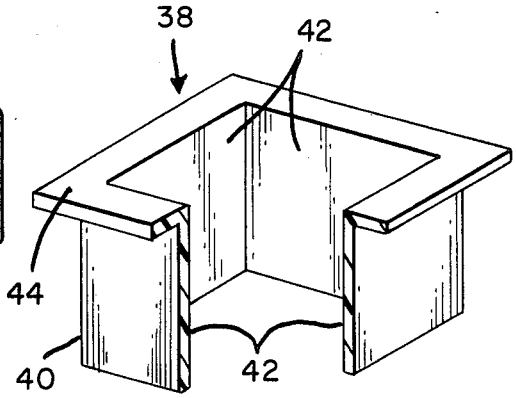
FIG. 8 is a perspective view of a ground support for the base, partially broken away.

As shown in FIG. 9, base 10 is mounted on the playing field 36 with the root extending into the interior of a buried ground support 38, shown in FIG. 8. The ground support includes a square prismatic section 40 defining four interior sidewalls 42 and an outward flange 44 extending around the top of the sidewalls. Support 38 is preferably formed from a suitable rigid plastic material, such as nylon, although it may be formed from other materials if, desired.

The ground support is buried in the playing field 36 at desired base location with the sidewalls oriented to assure that the desired orientation for base 10 inserted into the support. The support is preferably buried with flange 44 approximately 1 to 1½ inches below the level of the playing field.

Figure 10:
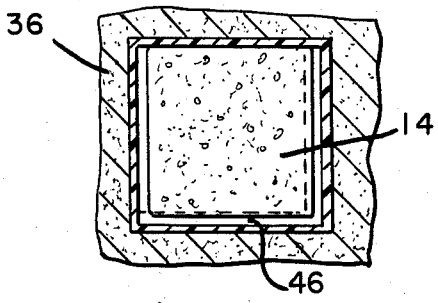
FIG. 10 is a sectional view taken along line 10—10 of FIG. 9 illustrating the root within the ground support.

As illustrated in FIG. 10, the square interior opening within section 40 is slightly larger than the cross section of root 14 fitted within the ground support. In the preferred embodiment of the invention, the root is seven inches square while the interior sides of the ground support are 7⅛ inches apart. With the base inserted into the ground support and resting on the surface of the field 36, root 52 is loosely confined within the ground support to provide a slight clearance 46 between the ground support and the root while assuring the ground support holds the base in proper angular position on the playing field. The root is free for limited movement in the support in all directions. The root extends below the cushion about 3½ inches, approximately one half its width.

Figure 11:
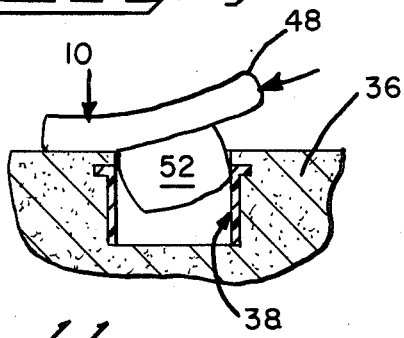
FIG. 11 is a view similar to FIG. 9 illustrating disengagement of the base from the ground support when a player slides into the base.

When playing the game of baseball, base 10 is used in exactly the same way as a conventional base is used. Players sliding into the base first engage a side 48 of the cushion and, with further movement toward the base, compress the body comprising the cushion and root. This compression absorbs momentum from the player sliding into the base. thereby lessening the shock of contact with the base. Continued compression of the base buckles cushion and root upwardly as shown in FIG. 11 to free the root from the ground support 38, thereby preventing injury to the player sliding into the base. During compression of the base, the strong joint 28 and reinforcement cloths 24 bonded to the body assure the cushion and root do not shear apart.

The space 46 between root 14 and the ground support provides sufficient room for the root to rotate up from the support and to free the base from the ground support. A player sliding into one side of the base, seats the opposite side of the root against the ground support and, with compression of the base rotates the root up and out of the ground support. Compression of the root in one direction causes the opposite sides to bow out, increasing the lateral width of the root. The clearance 46 prevents the expanded lateral sides of the root from binding against the adjacent ground support sidewalls. Such binding could prevent the base from popping out of the ground support cleanly.

The base pops free of the ground support no matter in which direction the player slides into the base. This is important since the game of baseball is unpredictable and the players may slide into bases in any direction, particularly when the game is played by young or amateur players. The length of the root is approximately one half its width and permits ready pop out of the base from the ground support.

If desired, the resiliency of the body material may be varied to provide a base having breakaway characteristics consistent with the requirements of particular types of players. For instance, for skilled adult players, a stiffer base may be required with more energy required to compress the base sufficiently to pop it out of the ground support. Conversely, for younger or unskilled players, a softer base may be required so that breakaway occurs at lower energy levels. In this way, the risk of injury may be adjusted in accordance with the requirements of given players and the energy required to pop the base from the ground support is less likely to injure the player.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What I claim my invention is:

1. For use in playing the game of baseball and the like, the combination of a safety base having a cushion with a top surface, sides and a bottom surface and a root joined to and extending outwardly from the center of the cushion bottom surface, the cushion and root being formed from a resilient energy absorbant material to define a body; and a ground support adapted to be buried in a playing field and having an interior opening for receiving the base root when the base bottom surface is positioned on the playing field, a loose fit clearance between the root and the ground support opening in at least one direction along the playing field whereby a player sliding into the cushion in a direction perpendicular to such one direction compresses the body against the ground support, expands the root into the loose fit clearance, buckles the cushion and pops the root out of the ground support without binding.

2. The combination of claim 1 including a loose fit clearance between the root and ground support extending around the root so that a player sliding into the base in any direction pops the base from the ground support without binding.

3. The combination of claim 2 wherein the length of the root is equal to approximately one-half the width of the root.

4. The combination of claim 3 wherein the root includes means cooperable with means on the ground support for orienting the cushion on the playing field.

5. The combination of claim 4 wherein the root and opening are square.

6. The combination of claim 5 wherein the cushion is square approximately 14 to 15 inches on a side and has a thickness of approximately $2\frac{1}{4}$ to $3\frac{1}{2}$ inches and the root is approximately 7 inches square and has a length of approximately $3\frac{1}{2}$ inches.

7. The combination of claim 6 wherein the interior sides of the square opening of the ground support are approximately $7\frac{1}{8}$ inches apart.

8. The combination of claim 2 including a protective covering bonded to the body comprising right angle reinforcement means bonded to the cushion portion of the body and the root portion of the body and extending across the Vee between the cushion and root.

9. The combination of claim 8 wherein said protective covering includes a cloth bonded to the top surface, the sides and bottom surface of the cushion and overlying the portion of reinforcement means bonded to the cushion portion of the body, and a cloth wrapped around the root and bonded to the root with overlying ends, such cloth overlapping the portion of the reinforcement means bonded to the root portion of the body.

10. The combination of claim 9 wherein said body includes a cushion, a root, and a chemical bond securing the cushion and root together at the cushion lower surface.

11. The combination of claim 10 wherein the body is formed of a foamed synthetic material.

12. For use in playing the game of baseball the combination of a safety base comprising a flat rectangular cushion having a top surface, sides and a bottom surface, and a root joined to and extending downwardly from the center of the cushion bottom surface, the cushion and root being formed from resilient energy absorbant material to define a body; and a ground support independent of the base adapted to be buried in a playing field and having an interior opening for receiving the base root when the base is positioned on the playing field with the bottom surface resting on the field whereby a player sliding into the cushion compresses the body against the support and pops the root out of the ground support the base including a first protective cloth bonded to the top surface, sides and bottom surface of the cushion, second protective cloths extending across the Vee between the root and the bottom wall of the cushion and bonded to the root and cushion, and a third protective cloth bonded to and wrapped around the root.

13. A base as in claim 12 wherein the first and third cloths overlie the second cloths and ends of the third cloths overlie each other and are bonded together.

14. A base as in claim 12 wherein the root body material is secured to the bottom of the cushion core material by a chemical bond and including reinforcement cloths bonded to the bottom surface and root sides adjacent said joint.

* * * * *